US011480365B2

(12) United States Patent
Lerche

(10) Patent No.: US 11,480,365 B2
(45) Date of Patent: Oct. 25, 2022

(54) RETAINING BODY, HEATING DEVICE AND METHOD

(71) Applicant: STEGO-HOLDING GMBH, Schwäbisch Hall (DE)

(72) Inventor: Ulrich Lerche, Michelfeld (DE)

(73) Assignee: STEGO-HOLDING GMBH, Schwabisch Hall (DE)

( * ) Notice: Subject to any disclaimer, the term of this patent is extended or adjusted under 35 U.S.C. 154(b) by 503 days.

(21) Appl. No.: 16/709,243

(22) Filed: Dec. 10, 2019

(65) Prior Publication Data

US 2020/0182512 A1 Jun. 11, 2020

(30) Foreign Application Priority Data

Dec. 11, 2018 (DE) ..... 102018131766.2

(51) Int. Cl.
*F24H 9/20* (2022.01)
*F24H 3/10* (2022.01)

(52) U.S. Cl.
CPC ..... *F24H 9/2071* (2013.01); *F24H 3/102* (2013.01)

(58) Field of Classification Search
None
See application file for complete search history.

(56) References Cited

U.S. PATENT DOCUMENTS 3,662,149 A * 5/1972 Lipinski ..... E05B 17/0016 219/202
4,366,798 A * 1/1983 Goto ..... F02M 31/135 123/549

(Continued)

FOREIGN PATENT DOCUMENTS

CN 102026431 4/2011
CN 105165115 12/2015

(Continued)

OTHER PUBLICATIONS

European Patent Office Search Report in EP Application 19214893.0, dated Apr. 20, 2020.

*Primary Examiner* — Thor S Campbell
(74) *Attorney, Agent, or Firm* — Barnes & Thornburg LLP

(57) ABSTRACT

A retaining body for heating elements, in particular oval and round heating elements, having an outer part assembly and an inner part assembly which is arranged inside the outer part assembly and forms an elastic connection with the outer part assembly under mechanical tension, wherein the outer part assembly and/or the inner part assembly has/have a plurality of receptacles which are arranged distributed in the circumferential direction and in each of which a heating element is arranged, and the outer part assembly and the inner part assembly each comprise a polygon profile with polygon corners and polygon sides which connect the polygon corners. The invention is characterized in that the inner part assembly and the outer part assembly can be rotated relative to one another and are dimensioned in such a way that the polygon profiles are elastically deformed by a relative rotation between the inner part assembly and the outer part assembly in such a way that, in the mounted state, a press fit is formed in the region of the heating elements by the induced mechanical tension.

22 Claims, 4 Drawing Sheets

(56) References Cited

U.S. PATENT DOCUMENTS 4,822,980 A * 4/1989 Carbone ..... H05B 3/141 219/205
4,870,249 A * 9/1989 Kayanuma ..... F02M 31/135 392/397
4,874,924 A * 10/1989 Yamamoto ..... A01M 1/2077 392/391
5,845,384 A * 12/1998 Retzbach ..... F16D 1/0829 29/282
6,847,017 B2 * 1/2005 Starck ..... H05B 3/14 219/544
7,217,072 B1 * 5/2007 Haimer ..... B23B 31/1179 409/234
7,335,855 B2 * 2/2008 von der Luhe ..... H05B 3/50 219/520
8,541,722 B2 * 9/2013 Lauth ..... H05B 3/42 219/544
9,661,688 B2 * 5/2017 Mangold ..... F24H 3/0411
11,118,810 B2 * 9/2021 Base ..... F16L 53/38
11,351,708 B2 * 6/2022 Mühlemann ..... B29C 45/2806
2002/0040899 A1 4/2002 Chang
2011/0056931 A1 3/2011 Schlipf
2014/0263282 A1 9/2014 Riley et al.

FOREIGN PATENT DOCUMENTS

DE 19604218 8/1997
DE 102006018151 10/2007
EP 1625003 8/2010
GB 2143708 A 2/1985
WO WO 2013/060645 5/2013

* cited by examiner

RETAINING BODY, HEATING DEVICE AND METHOD

CROSS REFERENCE TO RELATED APPLICATIONS

This application claims priority to German Patent Application No. DE102018131766.2, filed Dec. 11, 2018. The disclosure set forth in the referenced application is incorporated herein by reference in its entirety.

The invention relates to a retaining body for heating elements with the features of the preamble of claim 1. The invention also relates to a heating device and a method for mounting the retaining body.

A retaining body of the type mentioned above is known from WO 2013/060645 A1, for example.

The constant change of day and night temperature as well as permanently extreme climatic conditions can be problematic for the electronics in systems and control cabinets. They cause the formation of condensation or frost, which can lead to corrosion. Corrosion increases the risk of malfunctions and operational failures due to leakage currents or flashovers. Constant climatic conditions are indispensable to prevent the formation of condensation and frost, to ensure perfect functioning and to increase the service life of the electronics. Heating devices or fan heaters are used for this purpose.

Such heating devices are usually equipped with electrical heating elements based on PTC semiconductor technology. The brackets for such heating elements must ensure good heat transfer on the one hand and secure fixation on the other. Frequent temperature changes can lead to material fatigue and thus to a reduction in the holding force for the heating elements. If the bracket fails completely, the device may fail completely.

An example of such a heating device with a PTC heating element is described in DE 10 2006 018 151 A1. Here the heating element is arranged in a centrally arranged recess of a heat exchanger. The heating element lies flat against the inner surfaces of the recess. The heating element is held in position in such a way that the ends of the side walls of the heat exchanger are bent inwards during assembly by the use of pressing tools. As a result, the inner surfaces lie so close to the heating element that the heating element is clamped flat.

The buckling of the side walls, however, represents a plastic deformation of the material which, in combination with frequent temperature changes, impairs the retaining function. It is not possible to replace the heating element due to the way in which the side walls are permanently plastically deformed.

WO 2013/060645 A1 describes a retaining body comprising an outer part and an inner part arranged in the outer part. The outer part and the inner part are designed as polygon profiles with polygon corners and polygon sides connected to the polygon corners. Between the inner part and the outer part, several receiving areas are formed in the circumferential direction in which the heating elements are arranged. The receiving areas are arranged in the corners of the polygon profiles. The sides of the polygon profile are elastically deformed in the assembled state and are under mechanical tension. The resulting contact force acts on the heating elements and keeps them in position. The retaining function is possible without additional clamping elements.

The diameter of the outer part is increased at first for mounting the retaining body. The outer part diameter is increased by heating and/or by applying a force acting radially outwards or inwards. The inner part is then inserted so that the heating elements are arranged in the receiving areas. If the inner part is in position, the outer part is cooled down again and/or relieved so that the outer part shrinks onto the inner part. As a result, the polygon sides deform elastically and build up a mechanical tension, which applies a contact force to the heating elements and fixes them in place.

The mounting step of changing the diameter of the outer part, which is necessary to fix the inner part and the heating elements inside the outer part, is time-consuming and cost-intensive.

The invention is therefore based on the object of improving a retaining body of the type mentioned above in such a way that a secure holding of the heating elements in the retaining body is possible despite frequent temperature changes and cooling of the heating device, wherein the retaining body is designed in such a way that simple assembly, in particular easier joining of the polygon profiles, is possible. Furthermore, the invention is based on the object of specifying a heating device with such a retaining body and a method for mounting such a retaining body.

According to the invention, the object is solved with a view to the retaining body through the subject matter of claim 1,
the heating device through the subject matter of claim 21,
and the method by the subject-matter of the claim 22.

Specifically, the object is solved by a retaining body for heating elements, in particular oval and round heating elements, having an outer part assembly and an inner part assembly, which is arranged inside the outer part assembly and forms an elastic connection with the outer part assembly under mechanical tension. The outer part assembly and/or the inner part assembly has/have several receptacles distributed in the circumferential direction, in each of which a heating element is arranged. The outer part assembly and the inner part assembly each comprise a polygon profile with polygon corners and polygon sides connecting the polygon corners. The inner part assembly and the outer part assembly are rotatable relative to one another and dimensioned in such a way that the polygon profiles are elastically deformed by a relative rotation between the inner part assembly and the outer part assembly in such a way that, in the assembled state, a press fit is formed in the region of the heating elements by the induced mechanical tension, in particular by a spring force.

The press fit according to the invention is present when the maximum dimension of the inner radial expansion of the outer part assembly is smaller than the minimum dimension of the outer radial expansion of the inner part assembly. The radial expansion relates to all components that are assigned to the respective assembly. For press fits, a mounting force is required to produce a friction-locked connection. The mounting force is initiated by the relative rotation.

The radial expansions of the inner part assembly and the outer part assembly of the retaining body according to the invention are therefore dimensioned in such a way that they overlap in the area of the receptacles for the heating elements. This allows the inner part assembly to be inserted into the outer part assembly in such a way that relative rotation between the assemblies is possible. The relative rotation and the geometry of the polygon profiles create a contact between the two assemblies. The inner part assembly presses the outer part assembly, in particular the polygon profile of the outer part assembly, radially outwards in the areas of the receptacles for the heating elements, as a result of which the polygon profiles elastically deform. Similarly, the inner part assembly is pressed inwards in the areas of the receptacles and thus elastically deformed. The rotation is continued and the polygon profiles are further elastically deformed until the heating elements are located in the provided receptacles. The elastic deformation is retained. The mechanical tension or spring force induced by the elastic deformation in the polygon profiles, i.e. in the polygon profiles of the outer part assembly and the inner part assembly, applies a contact force to the heating elements and fixes them in their respective receptacles. The continuous pressure is maintained even during the heating phase and ensures optimum heat transfer and fixation. In particular, the joining of the heating elements and the polygon profiles by the rotation and the resulting close connection improves the heat transfer of the heating device.

The heating elements are preferably arranged in one edge area within the retaining body. This is advantageous because the air flow that flows through the retaining body during operation is more concentrated at the edges. It is therefore particularly advantageous to arrange the heating elements in this area in order to improve heat transfer.

A retaining body according to the invention allows mounting without having to change the diameter of the outer part in an additional mounting step. The mounting of the retaining body can be carried out almost without tools and requires less work and time.

The retaining body according to the invention for heating elements is not only limited to use in a switch cabinet. Applications in other areas are not excluded.

Preferred embodiments of the invention are indicated in the subclaims.

In one embodiment, the heating elements are arranged in the mounted state between the polygon sides and/or the polygon corners. This allows different variations of the retaining body. For example, a retaining body is conceivable in which the heating elements are arranged exclusively in the polygon corners. Embodiments are also possible in which the heating elements are arranged between the polygon sides of the inner part assembly and the polygon corners of the outer part assembly or vice versa.

In a preferred embodiment, the receptacles comprise wall sections that are adapted to the heating elements and at least partially enclose them circumferentially. The larger and closer the contact between the polygon profiles or the receptacles and the heating elements, the better the heat transfer between the mentioned components.

In a particularly preferred embodiment, the wall sections of a receptacle are formed partly by the outer part assembly and partly by the inner part assembly. A first wall section has a curvature angle of $K>180°$ and a second wall section a curvature angle of $K<180°$. This has the advantage that the heating elements are almost completely enclosed by the wall sections, which results in a better transfer of heat and contact pressure.

In another preferred embodiment, the outer part assembly forms the receptacles and the inner part assembly the abutments for the heating elements or vice versa. When installed, the heating elements are pressed against the abutments. This results in a better transfer of contact pressure and heat. The holding function of the receptacles is sufficient to hold the heating elements for mounting. In the mounted state, the receptacles interact with the heating elements and the abutments to form a press fit that fixes the heating elements in a positive and non-positive manner between the inner part assembly and the outer part assembly. Advantageously, the receptacles for the heating elements are arranged in such a way that the polygon sides show maximum elasticity and keep the heating elements continuously under tension.

In order to bring the heating elements into a suitable position before mounting, a contact surface is arranged in front of each abutment in the direction of relative rotation. This facilitates the mounting of the inner part assembly and protects the heating elements during mounting. During relative rotation, the heating elements remain in contact with the polygon profile of the outer part assembly. The heating elements rub against the polygon profile. Since the contact surfaces are arranged directly in front of the abutments, the relative rotation is limited and the load on the heating elements due to friction is minimized.

In order to hold the heating elements in the suitable position prior to installation, the contact surfaces can be designed to be inclined or concave. The contact surfaces can be designed in such a way that they support the transfer of the heating elements into the receptacles during relative rotation, i.e. there is less resistance due to friction.

Alternatively, the contact surfaces may have other shapes which are advantageous for mounting.

In a preferred embodiment, a core is concentrically arranged in the inner part assembly and connected to the inner part assembly by webs. Preferably the webs should be as far away as possible from the heating element receptacles. This has a beneficial effect on the elastic deformability of the polygon profiles and the resulting mechanical tension or spring force which holds the heating elements in position. The core has an advantageous effect on heat dissipation and stability (honeycomb) of the retaining body. If the receptacles are formed on the polygon sides, the webs are connected to the inner sides of the polygon corners. If the receptacles are formed at the polygon corners, the webs are connected to the polygon sides of the polygon profile of the inner part assembly. Thus a greater elastic deformation or a greater contact force can be generated in the area of the receptacles. It is conceivable that the core is connected to the polygon profile in a different way.

In another preferred embodiment, the core forms an inner profile for holding a tool. The relative rotation is initiated via the inner profile. Various tools can be used. The type of tool depends on the shape of the inner profile, i.e. other tools are possible. Alternatively, the retaining body can be designed in such a way that the relative rotation can be initiated without tools, in particular by hand.

In a particularly preferred embodiment, the inner profile of the core is designed as a hexagon socket. This has the advantage that the relative rotation can be initiated with a hexagon key. The hexagon key is a standardized tool that is available in various sizes. This makes it easier to move different sizes of the inner profile and the retaining body, as no special tools need to be manufactured. Furthermore, the hexagonal shape (honeycomb) results in increased stability and a better frictional connection between the components.

It is advantageous if a regulating unit is arranged on the core, particularly within the inner profile, which comprises a temperature regulator or a temperature monitor and a temperature fuse which are connected to the heating elements via a star connection. This allows easy installation of the electronic components. Alternatively, further electronic components and possibilities for mounting the regulating unit are conceivable. For example, it is conceivable that two bi-metal regulators or a bi-metal regulator and a protective fuse are arranged on the heating device and regulate the temperature of the heating device or switch it off in the event of overheating.

The polygon profiles comprise at least three polygon corners and three polygon sides. This means that embodiments with more sides and corners, which can have more receptacles and heating elements, are possible.

Advantageously, the adjacent polygon corners of the polygon profiles each have the same distance angle. The symmetrical cross-section allows uniform cooling during the manufacturing process. The symmetry and similar structure of the two polygon profiles allow the polygon profiles to be inserted into each other without producing overlaps of the radial expansions.

It is advantageous if in the assembled state the polygon corners of the polygon profiles are offset relative to one another in such a way that the polygon corners are aligned at least approximately centrally to the opposite polygon sides. This arrangement favors an even distribution of stress and thus an even distribution of the contact force. This determines the power ratio and the system is not under-constrained or over-constrained. Another advantage is that the offset arrangement of polygon corners and polygon sides creates air ducts that enable more efficient cooling and heat transport.

For the same purpose, the polygon corners of the polygon profiles can also be aligned approximately identically.

Advantageously, the polygon profiles are designed in a concave, convex or straight manner. This type of design of the polygon profile results in higher mechanical tension, which improves the press fit between the inner part assembly and the outer part assembly. Other suitable geometric shapes of the profiles are also conceivable, which will result in a higher mechanical tension of the polygon profiles and improve the holding function.

The polygon profiles can have a ribbed structure or a lamellar structure. The resulting increase in surface area improves heat exchange with the environment. Essentially, almost all surfaces of the retaining body are suitable for a ribbed structure. The inner surfaces of the receptacles as well as the abutments are adapted to the heating elements. They lie flat against the heating elements and largely enclose them. This enables good heat transfer between the heating elements and the polygon profiles. In principle, other structures for surface enlargement are also conceivable. Alternatively, the surface structures can be manufactured separately and joined to the surfaces of the retaining body or connected in other ways. This makes more complicated ribbed structures and better surfaces possible.

It is advantageous for mounting if the inner part assembly and the outer part assembly are arranged concentrically. A concentric arrangement of the assemblies results in a uniform distribution of tension in the mounted state in the polygon profiles and centers the two assemblies.

It is preferable to form the heating elements cylindrical or oval-cylindrical. Heating elements with round or at least partially round outer surfaces do not tilt during relative rotation. Alternatively, heating elements with other shapes are conceivable.

The outer part assembly can be assembled from several parts and closed with plates, in particular aluminum plates. This allows a higher surface structure to be achieved during production.

Within the scope of the invention, a heating device with a retaining body is disclosed and claimed. An axial end of the retaining body is connected to a fan in such a way that air can flow through the retaining body in the longitudinal direction.

Within the scope of the invention, a method for mounting a retaining body according to the invention and according to claim 1 is disclosed and claimed. The heating elements are arranged in the corresponding receptacles. The inner part assembly is then inserted into the outer part assembly and rotated with a tool that interacts with the core until the heating elements are fixed between the inner part assembly and the outer part assembly by the mechanical tension induced by the elastic deformation of the polygon profiles.

The invention is explained in closer detail by means of several embodiment examples with reference to the attached schematic drawings, which show as follows.

Figure 1:
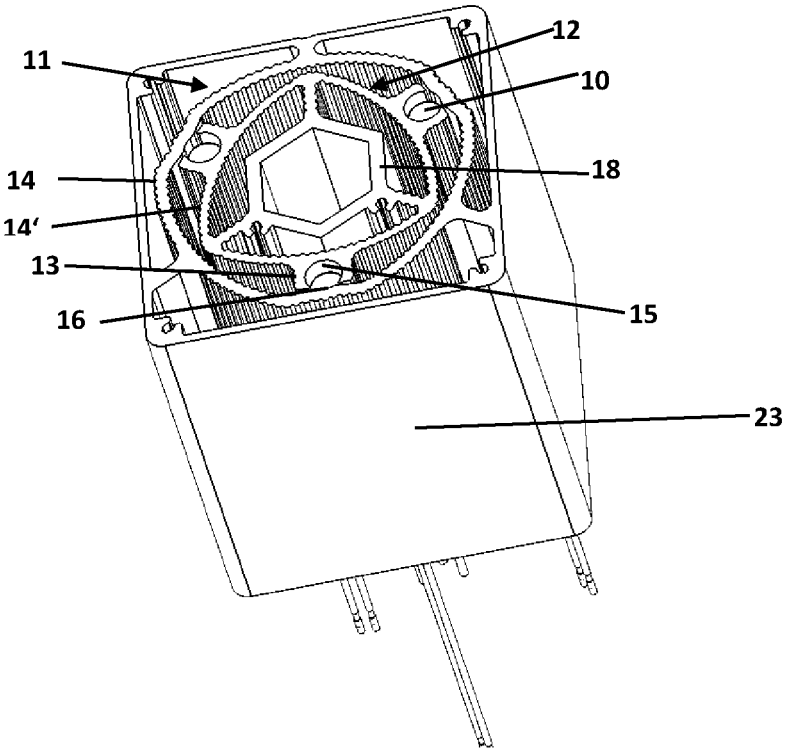
FIG. 1 shows a perspective view of an embodiment example of a retaining body according to the invention.
Figure 2:
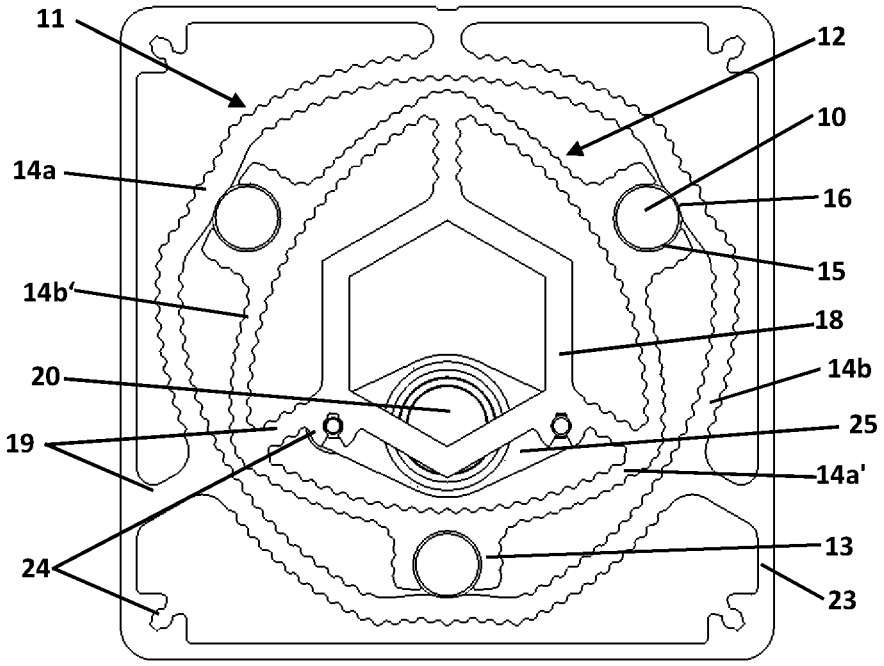
FIG. 2 shows a top view of the retaining body according to FIG. 1.

FIG. 1 and FIG. 2 show an embodiment example of a retaining body according to the invention. The retaining body comprises an outer part assembly 11 and an inner part assembly 12, which is arranged concentrically in the outer part assembly, and heating elements 10 arranged between the inner part assembly 12 and the outer part assembly 11. The retaining body is preferably made of aluminum and fulfils on the one hand a holding function and on the other hand a cooling function.

The outer part assembly 11 comprises a first or an outer polygon profile 14. The inner part assembly 12 comprises a second or an inner polygon profile 14'. The first and second polygon profiles 14, 14' each comprise three first and second polygon corners 14*a*, 14*a*' and three first and second polygon sides 14*b*, 14*b*'. Variants and shapes with more than three first and second polygon corners 14*a*, 14*a*' and polygon sides 14*b*, 14*b*' are also conceivable. The number of first polygon corners corresponds to the number of second polygon corners 14*a*'. The first polygon corners 14*a* are flattened and show a concave curvature. The first and second polygon sides 14*b*, 14*b*' show a convex curvature. The case that the first polygon corners 14*a* show a concave curvature and the first and second polygon sides 14*b*, 14*b*' show a convex curvature is conceivable. The second polygon corners 14*a*' are rounded. It is possible that the first and second polygon corners 14*a*, 14*a*' and/or the first and second polygon sides 14*b*, 14*b*' are designed in a straight manner.

The outer part assembly 11 comprises a spacer frame 23 that encloses the first polygon profile 14. The spacer frame 23 is designed as a square. Alternatively, other shapes are possible (e.g. round). The spacer frame 23 can also be designed as a housing. The corners of the spacer frame 23 are rounded and each have a geometrically defined fixing point 24 on its inside. The fixing points 24 are designed as recesses over the entire axial length of the spacer frame 23. Other forms of fixing points 24, for example those which do not extend at all or only partially or in sections over the axial length of the spacer frame 23, are conceivable. The fixing points 24 can be used to fix the retaining body in a switch cabinet and/or to arrange a fan or a cover on the retaining body. It is conceivable to connect two or more retaining bodies with each other by means of the fixing points 24. A web 19 is formed in each case on each inner side of the spacer frame 23, connecting the spacer frame 23 with the first polygon profile 14. The spacer frame 23 can also be connected to the first polygon profile 14 in other ways. The spacer frame 23 and the first polygon profile 14 are preferably connected with webs 19 and designed as one component. The webs 19 are advantageously spaced as far as possible from the receptacles for the heating elements 10 in order to achieve a better spring effect and a preferably concentrated air flow in the area of the heating elements 10. Alternatively, the spacer frame 23 can be manufactured as a separate component.

The first polygon profile 14 has a lamellar or ribbed structure on the outer and inner surfaces of the first polygon sides 14*b* and on the outer surfaces of the first polygon corners 14*a*. The ribbed structure increases the surface area of the first polygon profile 14 and enables more efficient heat exchange with the environment. Other structures that increase the surface area are also suitable. The inner surfaces of the first polygon corners 14*a* and the inner surfaces of the receptacles 13 have no ribbed structure. The inner surfaces of the first polygon corners 14*a* form abutments 16 and interact with the receptacles 13. For efficient heat transfer, the surfaces of the abutments 16 and the receptacles 13 are matched to the surfaces of the heating elements 10.

The abutments 16 form part of a press fit and have a convexly shaped area in the middle, against which the heating elements 10 arranged on the inner part assembly 12 rest when assembled. The convex area reduces the gap between the heating elements 10 and the first polygon profile 14 and thus allows better heat transfer between the two assemblies. The abutments 16 can be shaped differently for better fixation. For example, the abutments 16 can be shaped so that they partially enclose the heating elements.

The inner part assembly comprises the second polygon profile 14', the heating elements 10 and a core 18. Receptacles 13 are formed centrally on the outer surfaces of the second polygon sides 14*b'*.

The receptacles 13 are each made up of two radially outwardly directed wall sections 15. The inner surfaces of the receptacles 13 are adapted to the outer surfaces of the heating elements 10. The heating elements 10 are formed cylindrically and extend almost over the entire axial length of the retaining body. Other heating elements 10, in particular oval-cylindrical heating elements 10 and those with different length dimensions, are conceivable. The wall sections 15 do not completely enclose the heating elements 10, but in such a way that the heating elements 10 are fixed radially to the outside in a form-fit manner and can move in the longitudinal direction. Thus, the two wall sections 15 of the receptacles 13 together have a curvature angle of K>180°. In each case, a section of the outer surfaces of the heating elements 10, which is aligned to the inner surfaces of the first polygon profile 14, is not enclosed by the receptacles 13. When mounted, these sections interact with the abutments 16 and form the press fit between the inner part assembly 12 and the outer part assembly 11. In addition, the sections of the heating elements 10 not enclosed by the receptacles 13 have the function of transferring heat to the outer part assembly 11.

Within the second polygon profile 14' the core 18 is arranged concentrically. The core 18 is connected to the inner sides of the second polygon corners 14*a'* by webs 19. This allows the second polygon sides 14*b'* to build up a higher mechanical tension. The core 18 has an inner profile. The inner profile is designed as a hexagon. Alternatively, other geometries of the inner profile are conceivable. The inner profile of the core 18 works together during mounting with a tool, in particular a hexagon key. The type and size of the tool depends on the shape of the inner profile. An initiation of the relative movement is therefore conceivable with other tools or by hand. A fixing point 24 is arranged at each of two webs 19 of the core 18. The structural features of the fixing points 24 correspond to those of the spacer frame 23. The fixing points 24 can be arranged in other positions.

A regulating unit 20 is arranged at the fixing points 24 by means of a screw connection. Other types of connections are possible for fixing, e.g. clamps or latching hooks. The regulating unit 20 comprises a temperature regulator or a temperature monitor 21 and a temperature fuse 22. It is conceivable that the regulating unit 20 comprises other or additional components. As shown schematically in FIG. 7, the components of regulating unit 20 are electrically connected to the heating elements 10 via a star connection. Alternatively, other circuit types are possible. The temperature regulator or temperature monitor 21 has the function of keeping the temperature approximately constant. The temperature can be measured or regulated by thermistors, thermocouples or temperature switches made of bimetal. The use of other methods is possible. In case of a defect or failure of the temperature regulator or the temperature monitor 21 and simultaneous occurrence of high temperatures, the temperature fuse 22 is triggered. Temperature fuse 22 comprises an electrical connection that melts at a certain limit temperature. If this temperature limit is exceeded, the temperature fuse 22 interrupts the electrical circuit and switches off the heating device to prevent damage. If the temperature fuse 22 has been triggered, the heating device is only ready for use again after a new temperature fuse 22 has been inserted.

The second polygon profile 14' has a ribbed or lamellar structure on the inner surfaces and on the outer surfaces of the second polygon corners 14*a'* and polygon sides 14*b'*. The webs 19, which connect the polygon profile 14' to the core 18, also have a ribbed structure. There is no ribbed structure on the inner surfaces of the receptacles 13, as the contact between the receptacles 13 and the heating elements must be as close and flat as possible to ensure good heat transfer. In general, all surfaces of the retaining body that are not in direct contact with the heating elements 10 can have a lamellar structure, a ribbed structure or alternatively another structure.

The radial expansions of the outer diameter of the inner part assembly 12 and of the inner diameter of the outer part assembly 11 of the retaining body are dimensioned in such a way that they preferably overlap in the areas of the receptacles 13 for the heating elements 10, whereby an oversize is formed in the areas of the receptacles 13 in each case. The inner part assembly 12 is arranged before mounting in the outer part assembly 11 in such a way that the areas with oversize of the outer part assembly 11 and the inner part assembly 12 are offset from each other. A relative rotation is initiated by a tool, in particular a hexagon key, which interacts with the core 18. Other tools adapted to the core 18 are also conceivable for initiating relative rotation.

By initiating the relative rotation, the areas of the inner part assembly 12 and the outer part assembly 11 overlap with oversize. This allows a press fit between the two assemblies, which fixes the inner part assembly 12 in the outer part assembly 11. Due to the relative rotation, a contact is first created between the two assemblies in the areas with interference. More precisely, the contact between the heating elements 10 and the outer part or inner part assembly 11, 12 is established. The inner part assembly 12 presses the outer part assembly 11, in particular the first polygon profile 14 of the outer part assembly 11, radially outwards in the area of the receptacles 13 for the heating elements 10, whereby the first and second polygon profiles 14, 14' elastically deform. The relative rotation is continued until the heating elements 10 are arranged in the provided receptacles 13. The first and second polygon profiles 14, 14' remain elastically deformed after the relative rotation.

The mechanical tension or spring force induced by the elastic deformation in the first and second polygon profiles 14, 14' applies a contact force to the heating elements 10. The convex shape of the first polygon corners 14*a* and the concave shape of the second polygon sides 14*b*' support the opposite mechanical tensions in the first and second polygon profiles 14, 14'. The heating elements 10 are fixed in a positive and non-positive manner in the receptacles 13 in such a way that temperature changes have little influence on the contact force.

Figure 3:
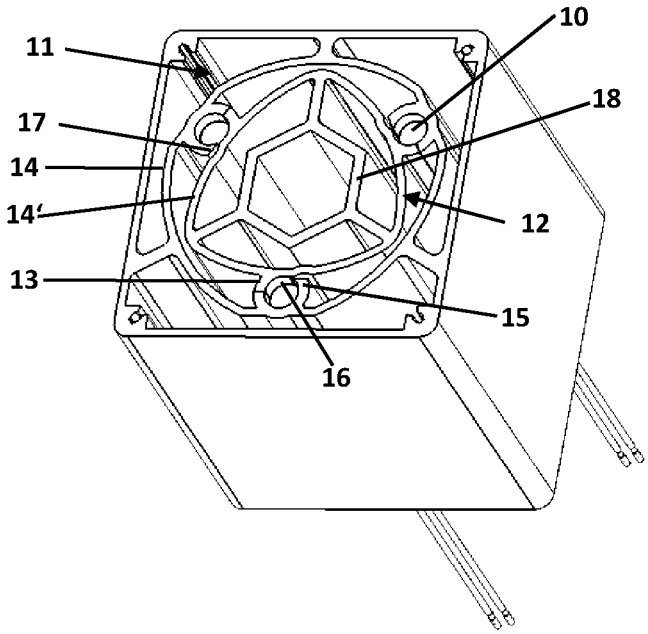
FIG. 3 shows a perspective view of another embodiment example of a retaining body in accordance with the invention.
Figure 4:
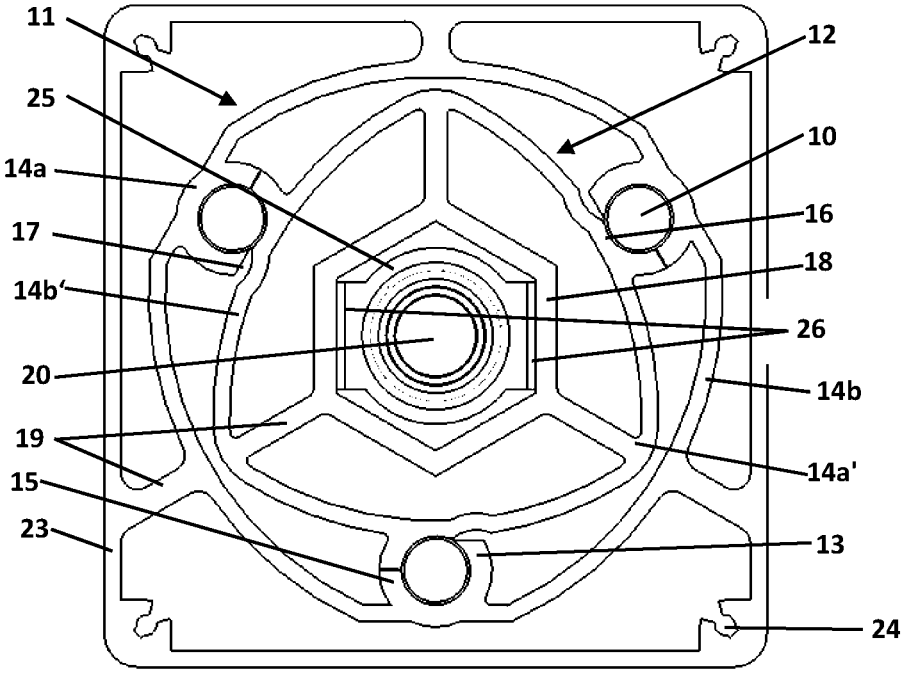
FIG. 4 shows a top view of the retaining body according to FIG. 3.

FIG. 3 and FIG. 4 show another embodiment example of a retaining body according to the invention.

The spacer frame 23 is identical to the spacer frame 23 described in FIGS. 1 and 2.

In this embodiment example, no surface of the retaining body has a ribbed or lamellar structure. In principle, however, all surfaces of the retaining body that are not in direct contact with the heating elements 10 are suitable to have a ribbed structure or another surface structure. It is therefore also conceivable that the spacer frame 23 has a ribbed or lamellar structure.

The geometry of the first polygon profiles 14, 14' essentially corresponds to that of the first and second polygon profiles 14, 14' of the embodiment example according to FIGS. 1 and 2. The differences are described in more detail in the following explanations.

Contrary to the embodiment example shown in FIGS. 1 and 2, the receptacles 13 of the retaining body shown in FIGS. 3 and 4 are not formed on the inner part assembly 12, but on the outer part assembly 11. More precisely, the receptacles are disposed on the inner surface of the first polygon corners 14*a* of the first polygon profile 14.

The wall sections 15 of the receptacles 13 extend radially inwards. The inner and outer surfaces of wall sections 15 are curved. The curvature angle of the wall sections 15 is K>180°. More than half of the circumference of the heating elements 10 is enclosed by the wall sections 15 of the receptacles 13. The curvature angle is selected in such a way that the heating element 10 arranged in the receptacle 13 can only move along the longitudinal axis of the retaining body. Differently shaped heating elements 10 and correspondingly differently shaped receptacles 13 are conceivable. The heating elements 10 are not completely enclosed by the wall sections 15 of the receptacles 13. The radially outermost section of the heating elements 10, starting from the center of the retaining body, remains free. The free section of the heating elements 10 interacts with abutments 16 and forms the press fit between the inner part assembly 12 and the outer part assembly 11.

The abutments 16 are arranged on the inner part assembly 12. More precisely, the abutments 16 are formed on the outer surfaces of the second polygon sides 14*b*' of the second polygon profile 14'. The abutments 16 are adapted to the heating elements 10 and partially enclose the heating elements 10. In addition, the abutments 16 have a curvature angle of K<180°. Preferably the sum total of the curvature angles of the wall sections 15 and the abutments 16 is approximately 360°. The heating elements 10 are thus almost completely enclosed by the receptacles 13 and the abutments 16 and show an almost optimal heat transfer from the heating elements 10 to the first and second polygon profiles 14, 14'.

The relative rotation of the inner part assembly 12, in which the inner part assembly 12 and the outer part assembly 11 are positively and non-positively connected to each other, is carried out counterclockwise in the embodiment example according to FIGS. 3 and 4. A variant in which mounting is carried out by turning it clockwise is also conceivable.

In the direction of the relative rotation, a contact surface 17 is positioned in front of the abutment 16. The contact surface 17 is designed as a concave curvature in the second polygon side 14*b*' of the second polygon profile 14'. In principle, other shapes are also conceivable for the contact surfaces 17. The heating elements 10 are arranged on the contact surfaces 17 before the relative rotation when the inner part assembly 12 is inserted into the outer part assembly 11, in order to bring the two assemblies into a suitable position for the relative rotation. Since the contact surfaces 17 are arranged directly in front of the abutments 16, only a small rotary movement or a small angle of rotation is necessary to fix the heating elements 10. This prevents the heating elements 10 from rubbing via the second polygon profile 14' and being damaged during the relative rotation.

Core 18 essentially corresponds to core 18 of the example shown in FIGS. 1 and 2. The differences are explained in more detail below.

The core 18 shown in FIGS. 3 and 4 does not include fixing points 24. The regulating unit 20 has a groove for a snap ring. The snap ring allows the regulating unit 20 to be placed in a bracket 25 and clamped together with the bracket 25 in the center of the inner profile of the core 18. For this purpose the bracket 25 has two laterally arranged clamping elements 26 which are aligned parallel to each other and, when installed, interact with two opposite inner sides of the inner profile of the core, in particular the hexagon socket.

The clamping elements 26 extend axially against the installation direction and each form an angle of at least 90°. To achieve a higher clamping force, the clamping elements have 26 teeth which extend against the mounting direction and are angled outwards. At the free axial ends of the clamping elements 26 a stop is formed which limits the installation depth of the bracket 25.

Figure 5:
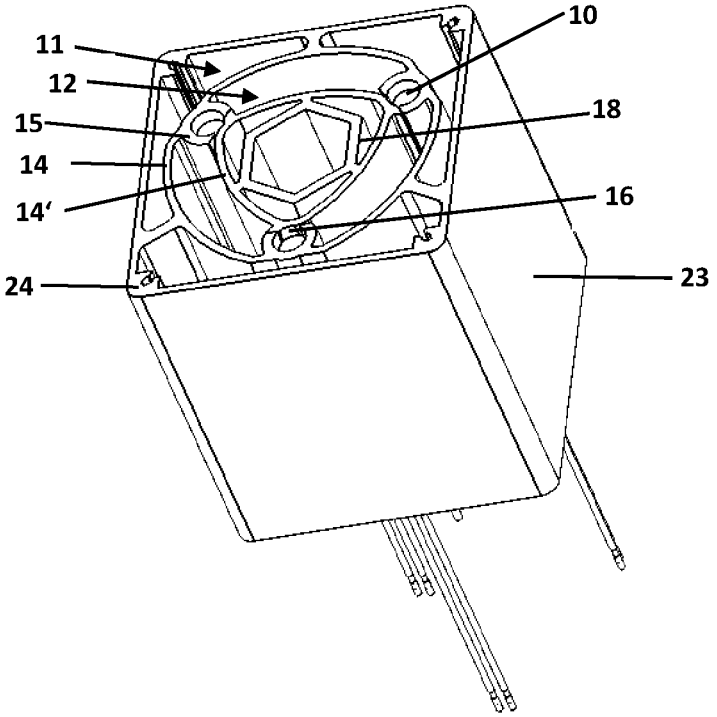
FIG. 5 shows a perspective view of another embodiment example of a retaining body in accordance with the invention.
Figure 6:
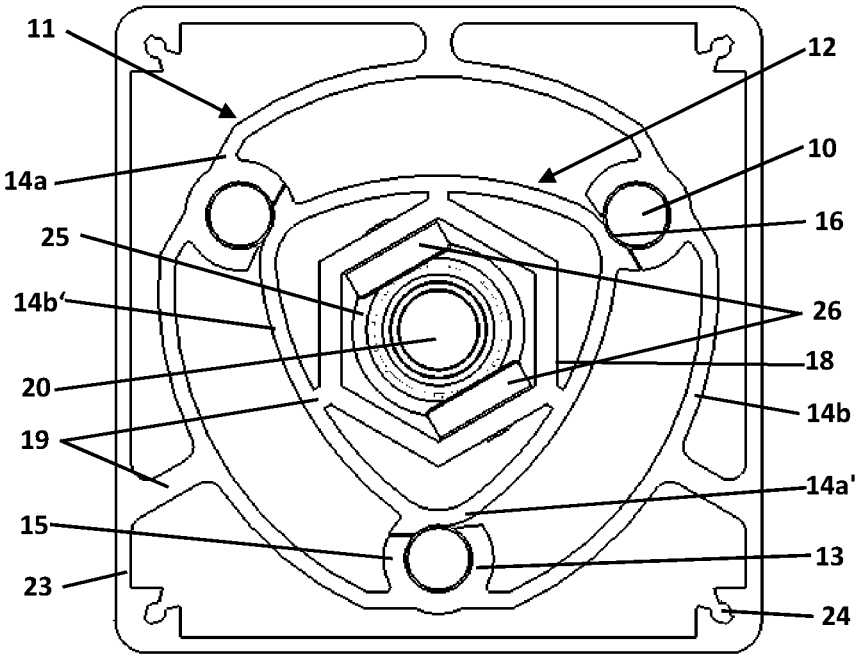
FIG. 6 shows a top view of the retaining body according to FIG. 5.

FIG. 5 and FIG. 6 show another embodiment example of a retaining body according to the invention.

The spacer frame 23 and the outer part assembly 11 are identical to the components from FIGS. 3 and 4.

The inner part assembly 12 in this example is designed in such a way that the abutments 16 for the heating elements 10 are arranged at the second polygon corners 14*a*'. As a result, the second polygon profile is 14' smaller than in the previous examples. The abutments 16 essentially correspond to the abutments 16 from FIGS. 3 and 4. In contrast, in the example shown in FIGS. 5 and 6, no contact surfaces 17 are formed, since the heating elements are only in contact with the second polygon side 14*b*' for a short section during relative rotation anyway.

The core 18 essentially corresponds to the core from FIGS. 1 to 4 with the difference that the webs 19 connect the core 18 to the inner surfaces of the second polygon sides 14*b*' and not to the inner surfaces of the second polygon corners 14*a*'. This has the advantage that a greater elastic deformation of the first and second polygon corners 14*a*, 14*a*' is possible.

The regulating unit 20 is arranged inside the core 18 by a circular bracket 25. The bracket 25 has clamping elements 26. The clamping elements 26 each form an angle of 90° and extend axially in the installation direction. The free axial ends are inclined inwards to make it easier to insert the bracket 25 into the core 18. The clamping elements 26 each have teeth that essentially correspond to the teeth in FIGS. 3 and 4. Alternatively, other shapes or structures are conceivable which increase the clamping force.

Figure 7:
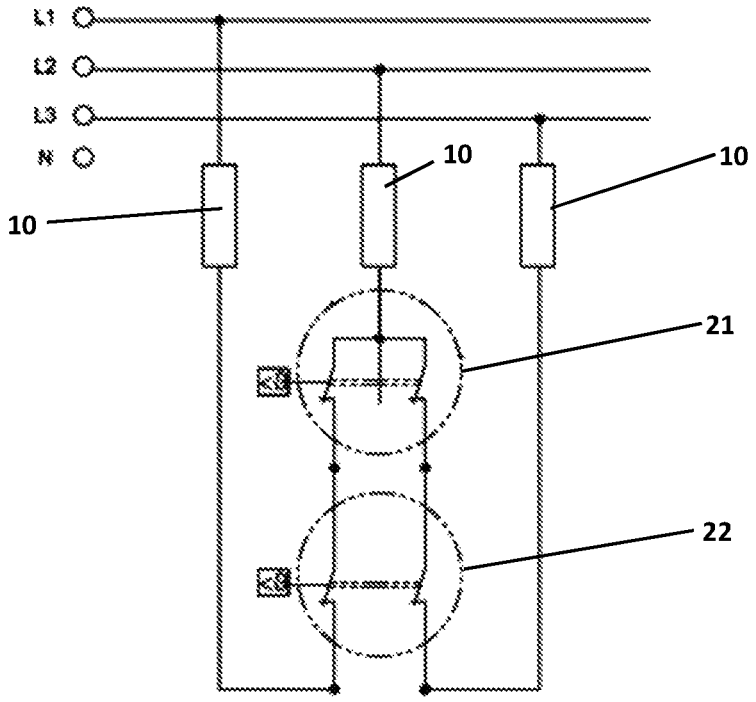
FIG. 7 shows a schematic circuit diagram of an embodiment example.

FIG. 7 shows an exemplary schematic diagram in which the heating elements 10 and the components of the regulating unit 20 are connected to each other via a star connection. The heating elements 10 are each connected to one phase of the voltage source. The temperature monitor 21 is arranged between the strings L1 and L3 and the heating elements 10. The temperature fuse 22 is arranged between the temperature monitor 21 and the heating elements 10 of the strings L1 and L3. A different arrangement of the components of the regulating unit 20 is conceivable. It is sufficient, in the event of an excessive temperature, to interrupt two strings in order to switch off the heating device.

Figure 8:
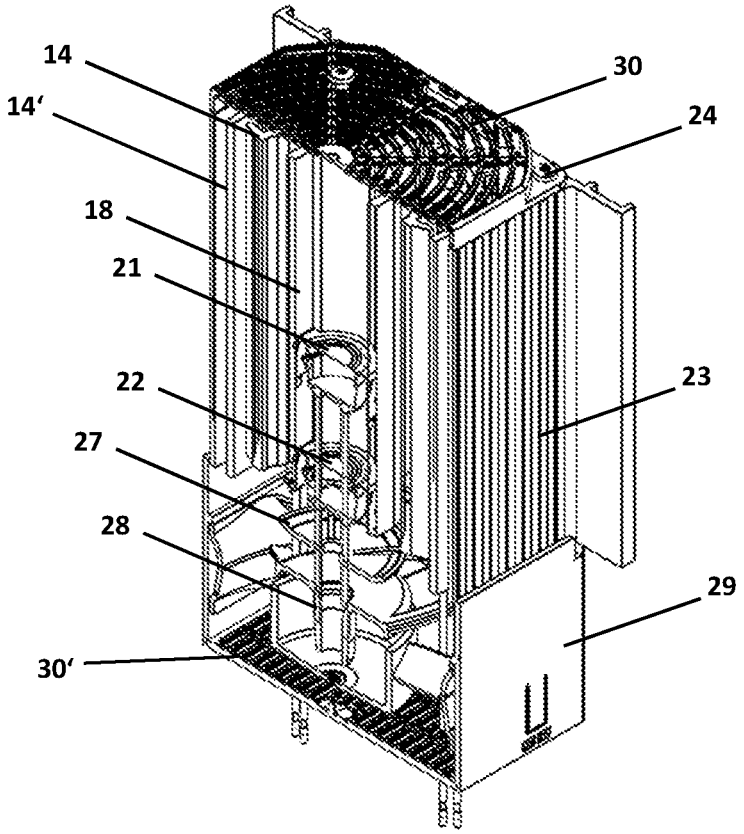
FIG. 8 shows a section of an embodiment example of a heating device according to the invention.

FIG. 8 shows an embodiment example of a heating device. The heating device comprises the retaining body with the spacer frame 23 and the first and second polygon profiles 14, 14'. The first and second polygon profiles 14, 14' have ribs. In all other respects, the polygon profiles 14, 14' essentially correspond to the polygon profiles 14, 14' described in FIGS. 1 and 2. The heating elements 10 are arranged between the polygon profiles 14, 14' analogous to FIGS. 1 and 2. A grid structure 30 is arranged at the axial end of the retaining body in the direction of the air flow. The grid structure 30 can be connected to the retaining body by means of the fixing points 24.

An attachment 29 is arranged at the opposite axial end of the retaining body. The attachment 29 comprises a fan 28, a circular disk 27 with webs and a grid structure 30'. Attachment 29 can be connected to the retaining body, for example by plugging it on and/or using the fixing points 24 or latching elements. The fan 28 is arranged inside the attachment 29, concentric to the retaining body. A circular disk 27 is arranged on the discharge side of fan 28. The diameter of the circular disk 27 corresponds approximately to the diameter of the inner profile of the core 18. Other shapes are conceivable for the circular disk 27. The circular disk has webs which extend radially and can be connected to the fixing points 24. The circular disk 27 protects the fan 28 from heat radiation. In addition, the circular disk 27 directs the air flow into the edge areas of the retaining body. This means that the air flow does not flow through the inner profile of the core 18, but preferably only through the edge areas where the heating elements 10 are preferably located. The heating elements 10 are arranged in the area of the highest air flow. A temperature regulator 21 and a temperature fuse 22 are arranged in the core 18.

LIST OF REFERENCE SIGNS

10 Heating elements
11 Outer part assembly
12 Inner part assembly
13 Receptacle
14 First polygon profile (outer part assembly)
14' Second polygon profile (inner part assembly)
14*a* First polygon corner (outer part assembly)
14*a*' Second polygon corner (inner part assembly)
14*b* First polygon side (outer part assembly)
14*b*' Second polygon side (inner part assembly)
15 Wall section
16 Abutment
17 Contact surface
18 Core
19 Web
20 Regulating unit
21 Temperature monitor
22 Temperature fuse
23 Spacer frame
24 Fixing points
25 Bracket
26 Clamping elements
27 Circular disk
28 Fan
29 Spacer frame
30 Grid structure

The invention claimed is:

1. A retaining body for heating elements, in particular oval and round heating elements, having an outer part assembly and an inner part assembly which is arranged inside the outer part assembly and forms an elastic connection with the outer part assembly which is under mechanical tension, wherein the outer part assembly and/or the inner part assembly has/have a plurality of receptacles which are arranged distributed in the circumferential direction and in each of which a heating element is arranged, and the outer part assembly and the inner part assembly each comprise a polygon profile having polygon corners and polygon sides which connect the polygon corners, wherein the inner part assembly and the outer part assembly are rotatable relative to one another and dimensioned such that the polygon profiles are elastically deformed by a relative rotation between the inner part assembly and the outer part assembly such that, in the mounted state, a press fit is formed in the region of the heating elements by the induced mechanical tension.

2. The retaining body according to claim 1, wherein in the mounted state the heating elements are arranged between the polygon sides and/or the polygon corners.

3. The retaining body according to claim 1, wherein the receptacles each have wall sections which are adapted to the heating elements and enclose these at least partially in the circumferential direction of the heating elements.

4. The retaining body according to claim 3, wherein the wall sections of a receptacle are each partially formed by the outer part assembly and the inner part assembly, wherein a first wall section has a curvature angle of $K \geq 180°$ and a second wall section is flat or has a curvature angle of $K < 180°$.

5. The retaining body according to claim 1, wherein the outer part assembly forms the receptacles and the inner part assembly abutments for the heating elements or vice versa, wherein the heating elements are pressed against the abutments in the installed state.

6. The retaining body according to claim 5, wherein a respective contact surface for the heating elements is arranged in front of the abutments in the installation direction in order to position the heating elements in a suitable position for mounting.

7. The retaining body according to claim 6, wherein the contact surface is formed obliquely or concave.

8. The retaining body according to claim 1, wherein a core is concentrically arranged in the inner part assembly and connected to the inner part assembly by webs.

9. The retaining body according to claim 8, wherein the core forms an inner profile for accommodating a tool.

10. The retaining body according to claim 9, wherein the inner profile of the core for accommodating a tool is formed as an internal hexagon.

11. The retaining body according to claim 8, wherein a regulating unit is arranged on the core and comprises a temperature monitor or a temperature regulator and a temperature fuse which are electrically connected to the heating elements by a star circuit.

12. The retaining body according to claim 1, wherein the polygon profiles comprise at least three polygon corners and three polygon sides.

13. The retaining body according to claim 12, wherein the adjacent polygon corners of the polygon profiles each have the same distance angle.

14. The retaining body according to claim 12, wherein in the mounted state, the polygon corners of the polygon profiles are offset with respect to one another such that the polygon corners are aligned at least approximately centrally with respect to the oppositely arranged polygon sides.

15. The retaining body according to claim 12, wherein in the mounted state, the polygon corners of the polygon profiles are aligned approximately identically.

16. The retaining body according to claim 1, wherein the polygon profiles are designed in a sectionally concave, convex or straight manner.

17. The retaining body according to claim 1, wherein the polygon profiles have a ribbed structure or a lamellar structure.

18. The retaining body according to claim 1, wherein the inner part assembly and the outer part assembly are concentrically arranged.

19. The retaining body according to claim 1, wherein the heating elements are designed in a cylindrical or oval-cylindrical manner.

20. The retaining body according to claim 1, wherein the outer part assembly is joined from a plurality of parts and is closed with plates, in particular aluminum plates.

21. A heating device having a retaining body according to claim 1, wherein an axial end of the retaining body is connected to a fan in such a way that air can flow through the retaining body in the longitudinal direction.

22. A method for mounting a retaining body according to claim 1, in which the heating elements are arranged in the associated receptacles, the inner part assembly is then inserted into the outer part assembly and rotated with a tool which cooperates with the core until the heating elements are fixed between the inner part assembly and the outer part assembly by the mechanical tension induced by the elastic deformation of the polygon profiles.

* * * * *